US007696873B2

(12) United States Patent
Sharma et al.

(10) Patent No.: US 7,696,873 B2
(45) Date of Patent: Apr. 13, 2010

(54) METHOD AND APPARATUS FOR AUTOMATICALLY DISARMING A SECURITY SYSTEM

(75) Inventors: Raman Kumar Sharma, Toronto (CA); Roger Parenteau, Toronto (CA); Juan Francisco Bogarin Muñoz, North York (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 483 days.

(21) Appl. No.: 11/519,351

(22) Filed: Sep. 12, 2006

(65) Prior Publication Data

US 2008/0068162 A1 Mar. 20, 2008

(51) Int. Cl.
*G08B 13/08* (2006.01)

(52) U.S. Cl. ..... 340/545.7; 340/545.1; 340/572.1; 340/572.4; 340/5.5; 340/506; 340/507; 340/425.5; 340/426.1

(58) Field of Classification Search ..... 340/545.7, 340/545.1, 572.1, 572.4, 5.56, 506, 507, 340/568, 425.5, 426, 508
See application file for complete search history.

(56) References Cited

U.S. PATENT DOCUMENTS 4,808,995 A * 2/1989 Clark et al. ..... 340/5.64
5,541,585 A * 7/1996 Duhame et al. ..... 340/5.62
5,790,015 A * 8/1998 Iitsuka ..... 340/426.28
5,969,637 A * 10/1999 Doppelt et al. ..... 340/825.69
6,057,764 A * 5/2000 Williams ..... 340/572.1
6,812,836 B2 * 11/2004 Soloway et al. ..... 340/542
6,930,604 B2 * 8/2005 Marino ..... 340/539.16
7,403,109 B2 * 7/2008 Martin ..... 340/516
2003/0006879 A1 * 1/2003 Kang et al. ..... 340/5.61
2005/0162254 A1 7/2005 Michishige et al.
2005/0174218 A1 8/2005 Jordan et al.

FOREIGN PATENT DOCUMENTS

WO WO 04/012163 A2 2/2004

* cited by examiner

*Primary Examiner*—Tai T Nguyen
(74) *Attorney, Agent, or Firm*—The Small Patent Law Group LLP

(57) ABSTRACT

A security system comprises a system control panel for arming and disarming the security system. A door sensing unit comprises a first radio frequency (RF) transceiver interconnected with the system control panel over a network. The first RF transceiver is mounted proximate to a door that defines at least a portion of a perimeter around an area to be monitored by the security system. The first RF transceiver has an RF detection field proximate to the door. A disarm device comprises a second RF transceiver that automatically transmits a disarm device packet. The first RF transceiver receives the disarm device packet when the second RF transceiver is within the RF detection field. The first RF transceiver sends a disarm message to the system control panel over the network to disarm the security system based on at least the disarm device packet.

5 Claims, 5 Drawing Sheets

METHOD AND APPARATUS FOR AUTOMATICALLY DISARMING A SECURITY SYSTEM

BACKGROUND OF THE INVENTION

This invention relates generally to security systems, and more particularly, to automatically disarming a security system to prevent false alarms.

Security systems are installed in homes and businesses to protect the premises within a perimeter. Unfortunately, a large number of false alarms are generated due to human error. The home or business owner is typically responsible for costs incurred by police or other security personnel who are sent to respond to a false alarm. Also, a great number of false alarms may result in slower response time during a true event or emergency due to less available security personnel or a perceived lack of urgency.

When the security system is armed, the person entering the home or business has to disable the alarm by, for example, entering a code into a panel or input device such as a keypad, or finding and holding a radio frequency identification (RFID) tag up to an RFID reader within a set amount of time. If the person is not aware that the system is armed or is unable to disarm the system within the set time, an alarm is generated. If the person is authorized to enter and has a key for the door lock but does not have the alarm code, they may be unaware that they are going to set off the alarm. Also, authorized workers or other people may be given proper access to the home or business, but may forget the code or enter a code for a different location which will trigger an alarm. Setting the system to disarm based on simply unlocking a door also causes security risks, as locks can be picked or potentially unlocked by breaking a window or door panel, then unlocking the door from the inside.

False alarms are also often generated when people are within the perimeter and have armed the sensors along the perimeter. This may be referred to as an Armed Stay Mode. If a window or door is opened without first disabling the system, an alarm will be generated. This may happen when a person opens the door to get the newspaper, let a pet in or out of the house, or to admit a visitor.

Therefore, a need exists for preventing false alarms by disarming the security system without human intervention while still maintaining the integrity and functionality of the security system. Certain embodiments of the present invention are intended to meet these needs and other objectives that will become apparent from the description and drawings set forth below.

BRIEF DESCRIPTION OF THE INVENTION

In one embodiment, a security system comprises a system control panel for arming and disarming the security system. A door sensing unit comprises a first radio frequency (RF) transceiver interconnected with the system control panel over a network. The first RF transceiver is mounted proximate to a door that defines at least a portion of a perimeter around an area to be monitored by the security system. The first RF transceiver has an RF detection field proximate to the door. A disarm device comprises a second RF transceiver that automatically transmits a disarm device packet. The first RF transceiver receives the disarm device packet when the second RF transceiver is within the RF detection field. The first RF transceiver sends a disarm message to the system control panel over the network to disarm the security system based on at least the disarm device packet.

In another embodiment, a method for automatically disarming a security system comprises transmitting an RF packet with a disarm device. The RF packet comprises at least one identifier (ID) associated with at least one of the disarm device and the security system. The RF packet is received with an RF transceiver interconnected with the security system. At least one ID is compared to at least one value associated with approved disarm devices and the security system. The security system is disarmed when the at least one ID is the same as or corresponds to the at least one value.

In another embodiment, a security system comprises a system control panel for arming and disarming the security system. The security system is set to a security system mode, which may comprise at least one Armed Mode and a Disarmed Mode. The security system has means for detecting at least one of motion and a disarm device packet proximate to a door monitored by the security system. Means are provided for setting the security system to the Disarmed Mode based on at least one of the motion and the disarm device packet.

DETAILED DESCRIPTION OF THE INVENTION

Figure 1:
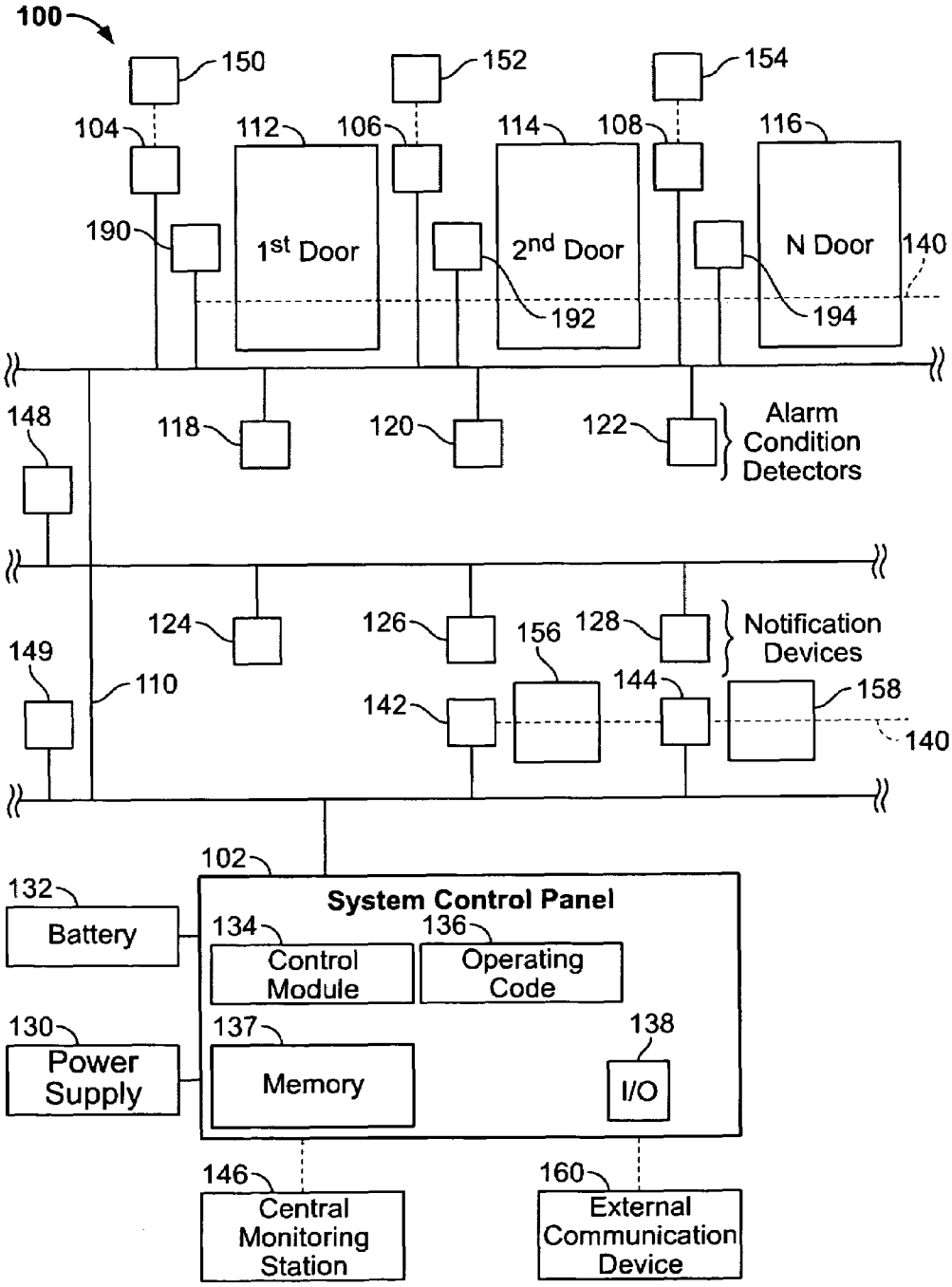
FIG. 1 illustrates a security system which has a system control panel for monitoring and/or controlling devices installed on a network in accordance with an embodiment of the present invention.

FIG. 1 illustrates a security system 100 which has a system control panel 102 for monitoring and/or controlling devices installed on a network 110. The devices may detect and/or control door openings and closings, detect motion, detect alarm conditions, notify people within an area about alarm conditions, or accomplish other functions which may be desired. For example, the system 100 may be used within a light industrial building or a residence.

The system 100 has one or more door sensing units, such as first door sensing unit 104, second door sensing unit 106 through N door sensing unit 108 which may be configured to monitor first door 112, second door 114, through N door 116, respectively. Each of the first through N sensing units 104-108 may receive signals from and send signals to, any of first, second through N disarm devices 150, 152 and 154. By way of example only, the signals may be electrical signals, packets, and the like. The first through N sensing units 104-108 communicate with the system control panel 102 over the network 110. Each of the door sensing units 104, 106, and 108 has a unique address on the network 110. Optionally, first, second through N input devices 190, 192 through 194 may be mounted proximate to first, second through N doors 112, 114 and 116 or in other convenient locations to allow a user to manually change a system mode, enter data such as a security code, and manually arm and disarm the system 100.

First through N window sensors 142 and 144 monitor first through N windows 156 and 158 for unauthorized opening or glass breaking. The first through N doors 112-116 and the first through N windows 156-158 may define, or partially define, a perimeter 140 around an area to be monitored by the security system 100. Therefore, the first through N door sensing units 104-108 and the first through N window sensors 142 and 144 may also be referred to as perimeter monitoring devices. Additional perimeter monitoring devices (not shown) may be used. Also, one or more motion sensors 148 and 149 may be used within the perimeter 140 to detect motion within the monitored area.

Alarm condition detectors 118, 120 and 122 may be connected on the network 110 and are monitored by the system control panel 102. The detectors 118-122 may detect fire, smoke, temperature, chemical compositions, or other hazardous conditions. When an alarm condition is sensed, the system control panel 102 transmits an alarm signal to one or more addressable notification device 124, 126 and/or 128 through the network 110. The addressable notification devices 124, 126 and 128 may be horns and/or strobes, for example.

The system control panel 102 is connected to a power supply 130 which provides one or more levels of power to the system 100. One or more batteries 132 may provide a back-up power source for a predetermined period of time in the event of a failure of the power supply 130 or other incoming power. Other functions of the system control panel 102 may include displaying the status of the system 100, resetting a component, a portion, or all of the system 100, silencing signals, turning off strobe lights, and the like.

The network 110 is configured to carry power and communications to the addressable notification devices 124-128 from the system control panel 102. Each addressable notification device 124-128 has a unique address and may be capable of communication with the system control panel 102. The addressable notification devices 124-128 may communicate their status and functional capability to the system control panel 102 over the network 110.

The system control panel 102 has a control module 134 which provides control software and hardware to operate the system 100. Operating code 136 may be provided on a hard disk, ROM, flash memory, stored and run on a CPU card, or other memory. An input/output (I/O) port 138 provides a communication interface at the system control panel 102 with an external communication device 160 such as a laptop computer.

A central monitoring station 146 may receive communications from the system control panel 102 regarding security problems and alarm conditions. The central monitoring station 146 is typically located remote from the system 100 and provides monitoring to many security systems.

During normal operation, the security system 100 may be set in several modes, such as Armed Away Mode, Armed Stay Mode and Disarm Mode. Other modes of operation may be used. The modes of the system 100 may be changed by entering a code at the system control panel 102, at one of the first through N input devices 190-194 located proximate to a door or other desirable location, or with the disarm devices 150-154. Armed Away Mode arms all of the security features, such as the first through N door sensing units 104-108, first through N window sensors 142 and 144, as well as the motion sensors 148 and 149 within the perimeter 140. This mode may be desirable when no people are within the perimeter 140. Armed Stay Mode arms the perimeter monitoring devices, such as the first through N door sensing units 104-108 and the first through N window sensors 142 and 144. This mode will generate an alarm when any of the first through N doors 112-116 or first through N windows 156 and 158 are opened or otherwise compromised, but allows people to move about within the perimeter 140 without generating an alarm. The Disarm Mode disarms the perimeter and motion detectors, but may not disarm the alarm condition detectors 118-122 which may be armed in all modes.

It should be understood that the system 100 may allow a user to choose which devices interconnected on the network 110 are armed and which are not armed in each mode, as well as to define additional modes. For example, zones may be established such that a first set of perimeter monitoring devices are armed while a second set is not armed. This may be desirable when the security system 100 is shared between more than one business, or when it is desired to monitor only a portion of the entire area. For example, a home owner may wish to arm all doors and windows except those along the back side of the home, allowing the occupants to move between the backyard and the interior freely without setting of the alarm.

Figure 2:
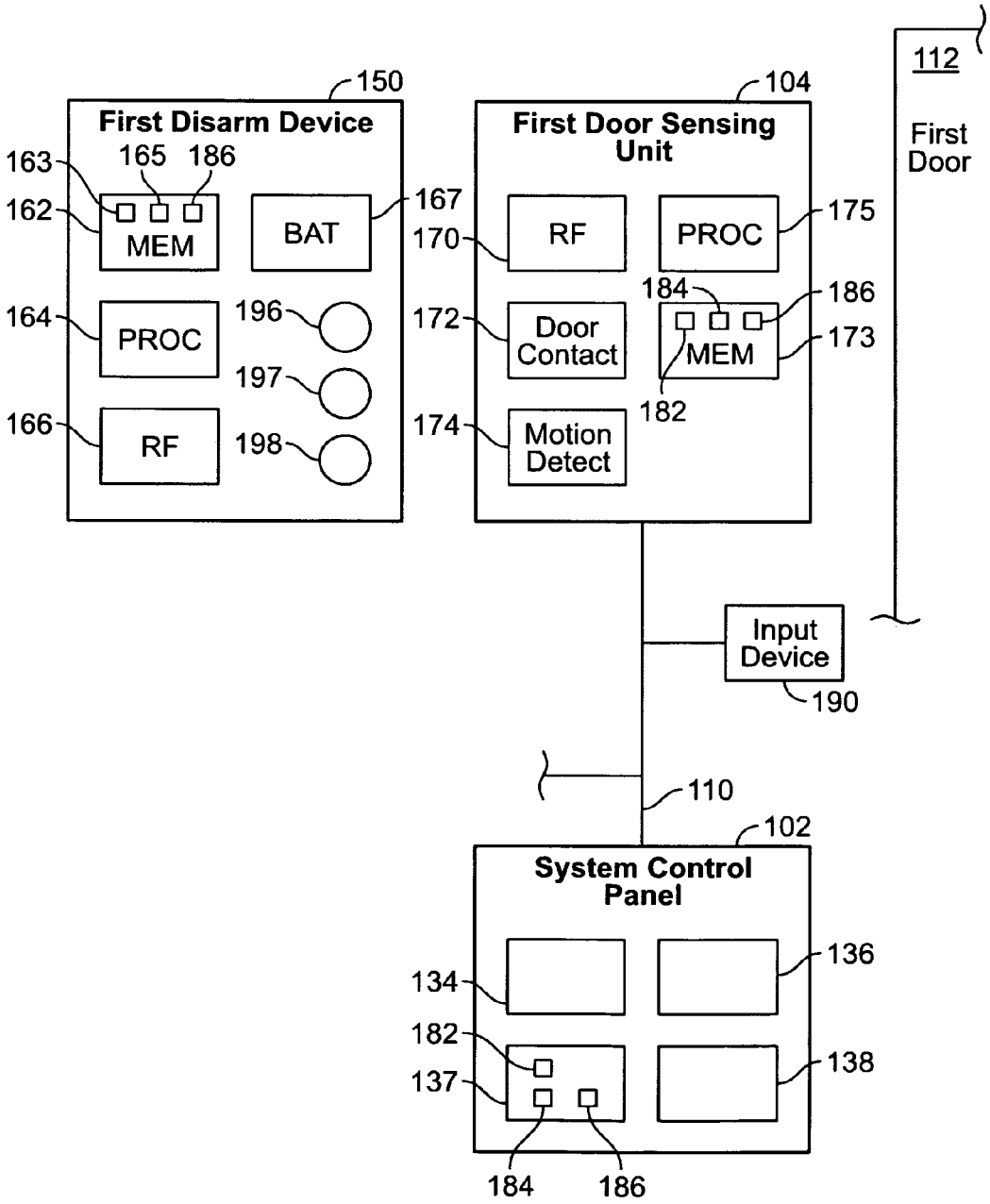
FIG. 2 illustrates a block diagram of a disarm device, a door sensing unit, and an input panel mounted proximate to a door in accordance with an embodiment of the present invention.

FIG. 2 illustrates a block diagram of the first disarm device 150, first door sensing unit 104, and the first input device 190 mounted proximate to the first door 112. It should be understood that the second through N disarm devices 152 and 154 have similar functionality and configuration as the first disarm device 150, and thus will not be discussed in detail.

Each of the first through N disarm devices 150-154 are small in size and easily portable. For example, a user may keep one of the disarm devices 150-154 in a pocket, briefcase, purse, backpack and the like. The first disarm device 150 has a memory 162 for storing knowledge about the system 100, a processor 164, an RF transceiver 166, and a battery 167.

The first door sensing unit 104 has an RF transceiver 170, a door contact 172 and a motion detector 174. The door contact 172 may be wireless and may be used to detect whether the first door 112 is open or closed. The motion detector 174 may be a passive infrared (IR) detector or other type of motion detector and may sense motion proximate to the inside of the first door 112 (within the perimeter 140). A memory 173 and a processor 175 may also be within the first door sensing unit 104

A unique Device Identifier (ID) 163, such as an identification code, token, or other security code is stored in the memory 162 of the first disarm device 150 and is used by the system 100 to authenticate the first disarm device 150. Each disarm device 150-154 is preauthorized and may have its own unique Device ID 163. A Default System ID 165 corresponding to a Default System ID associated with the system 100 is also stored in the memory 162. The information stored in the memory 162 is used by the first disarm device 150 to form RF data packets, herein referred to as disarm device packets. It should be understood that although RF data packets are discussed, other forms of wireless communication may be used.

A list of approved Device IDs 182, the Default System ID 184, and a unique System ID 186 assigned to the system 100, may be stored in the memory 137 of the system control panel 102, memory 173 of the first door sensing unit 104, or other memory on the system 100. Alternatively, a single ID may be used rather than assigning unique Device and System IDs.

The first disarm device 150 may operate in one of at least three modes, such as Installation Mode, Polling Mode, and Button Pressed Mode. The Polling Mode is the operating mode in which the first disarm device 150 will operate most of the time, such as when the system 100 is in any of Armed Away Mode, Armed Stay Mode, and Disarm Mode. The RF transceiver 170 of the first door sensing unit 104 detects transmissions from the first disarm device 150 and determines the action needed based on the mode the system 100 is in, as well as the status and/or input of other sensors and devices on the system 100.

The system 100 may initially be put into an Installation Mode, such as through the input device 190 or system control panel 102. The first disarm device 150 is automatically transmitting a disarm device packet having the Default System ID 165 and the Device ID 163. Upon receiving a disarm device packet having the Default System ID 165, the first door sensing unit 104 verifies that the Device ID 163 is valid and may generate and send an acknowledgement signal, such as an acknowledgement packet, with the System ID 186 unique to the system 100. The first disarm device 150 stores the System ID 186 of the system 100 in flash memory or other non-volatile memory 162. Therefore, if the battery 167 fails or is removed for any reason, the first disarm device 150 does not need to be reset. The first door sensing unit 104 may remain in Installation Mode until receiving an acknowledge message from the first disarm device 150 (as well as from any other disarm device being installed), which may be a disarm device packet having the System ID for the system 100, indicating that the correct System ID 186 has been received and saved successfully.

Each of the disarm devices 150-154 may be provided with buttons available to the user for manually setting the mode of the system 100. For example, pressing Arm button 196 may send an Arm Command Device Data Packet to set the system 100 to one of Armed Away Mode and Armed Stay Mode, Disarm button 197 may send a Disarm Command Device Data Packet to set the system 100 to Disarmed Mode, and Status button 198 may send a Request Status Device Data Packet to request an acknowledge packet that will indicate to the user what mode the system 100 is in. For example, one or more LEDs (not shown) may be set to flash to indicate Armed and Disarmed modes. Optionally, the first door sensing unit 104 may be provided with the ability to produce a sound or chirp to indicate mode.

Figure 3:
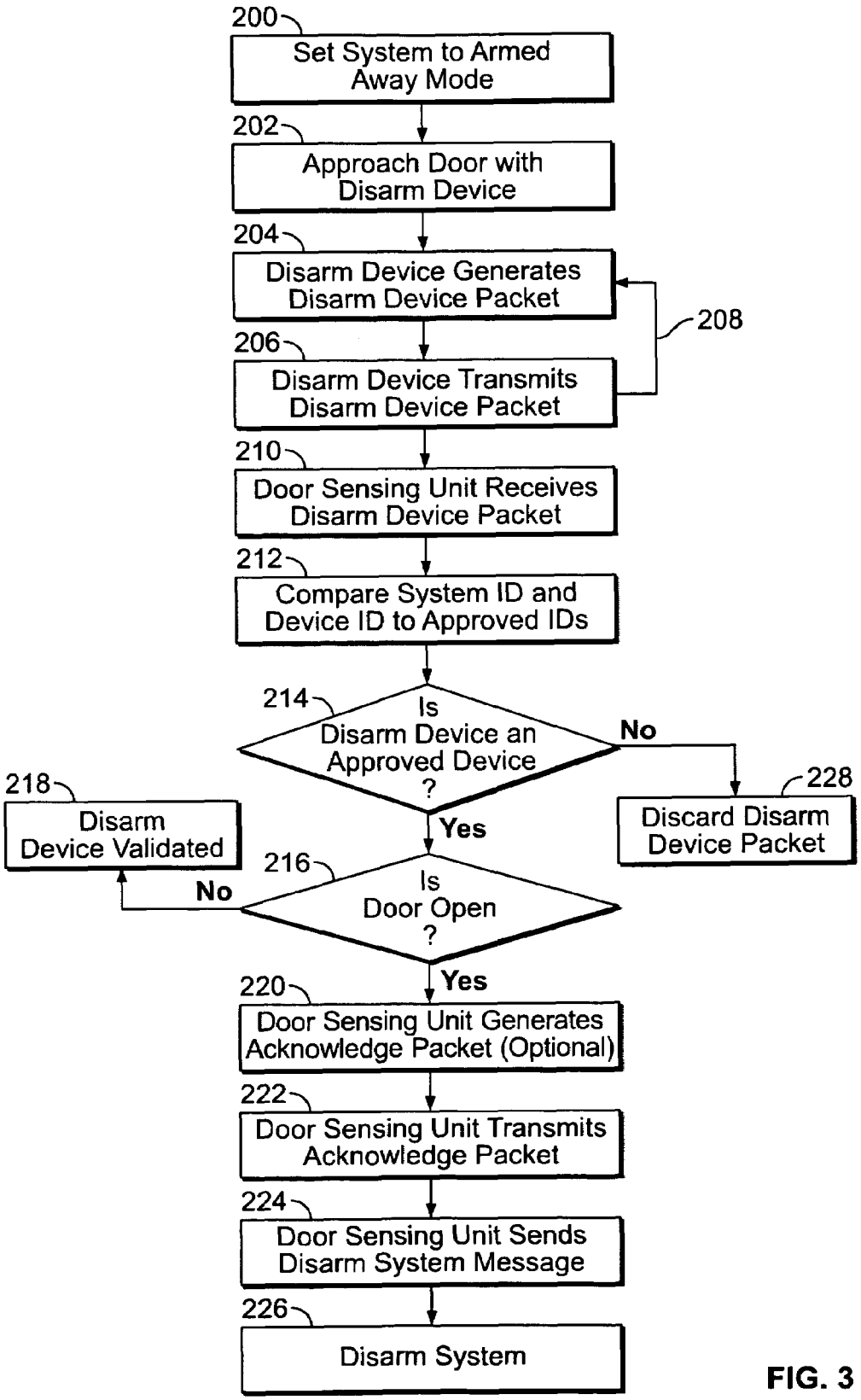
FIG. 3 illustrates a method for disarming the security system of FIG. 1 using the disarm device of FIG. 2 in accordance with an embodiment of the present invention

FIG. 3 illustrates a method for disarming the security system 100 using one of the disarm devices 150-154. Although the first disarm device 150 is used to disarm the first door 112 in the following discussion, it should be understood that any of the first through N disarm devices 150-154 having a valid Device ID 163 may be used to disarm the security system 100 at any door monitored by the security system 100.

Figure 4:
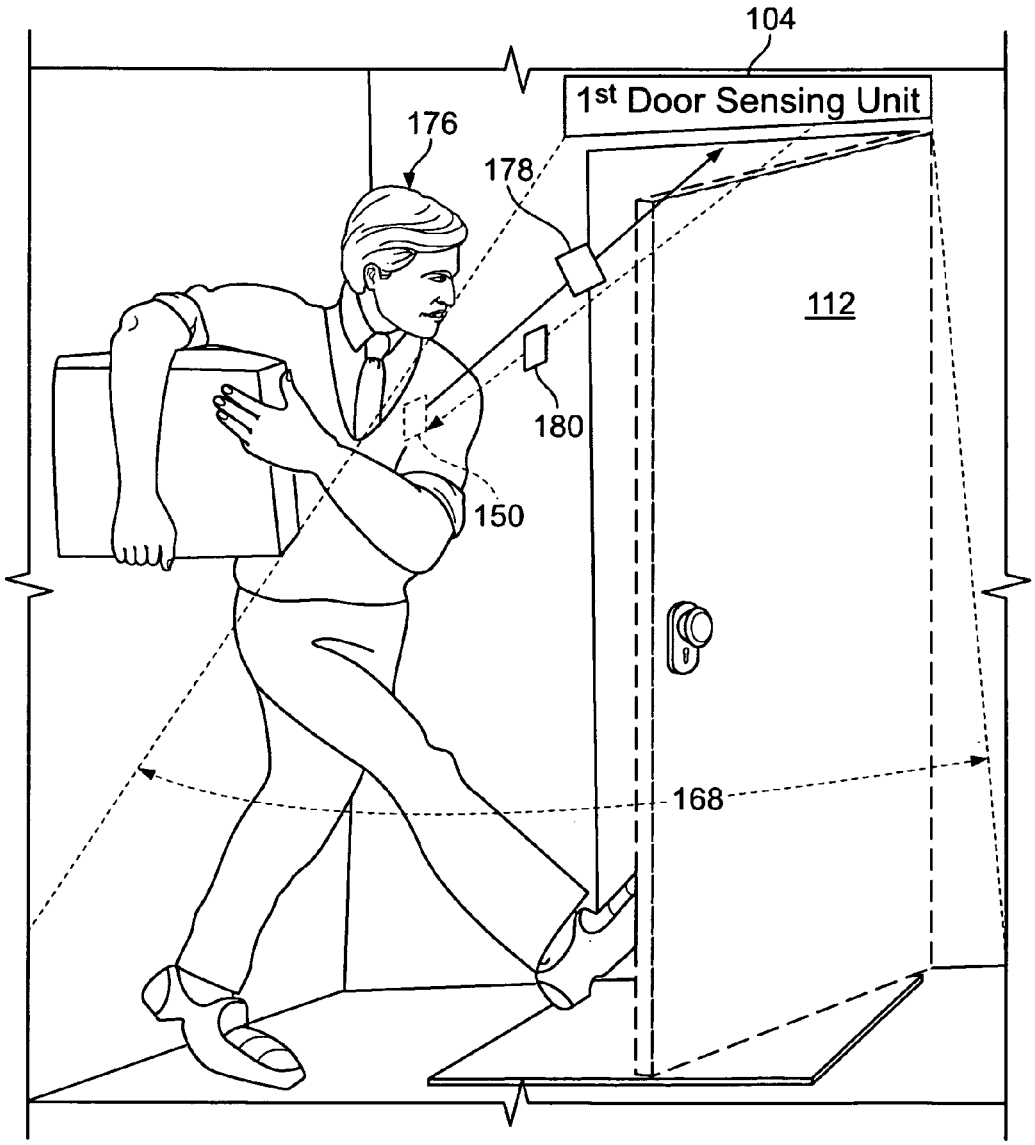
FIG. 4 illustrates a person using the disarm device of FIG. 2 to disarm a door in accordance with an embodiment of the present invention

FIG. 4 illustrates a person 176 using the first disarm device 150 to disarm the first door 112. The first door sensing unit 104 is installed proximate to the first door 112 and has an RF detection field 168 in which the RF transceiver 170 (FIG. 2) can detect RF data packets sent by the disarm devices 150-154. Anyone moving close to or through the first door 112 will move into the RF detection field 168. The RF detection field 168 comprises area on both sides of the first door 112; in other words, the RF detection field 168 extends both outside and inside of the perimeter 140 (FIG. 1). The RF transceiver 170 is usually in a receive mode, and may only transmit after receiving an RF packet (disarm device packet) while the door contract 172 indicates an open state. FIGS. 2-4 will be discussed together.

At 200 (FIG. 3), the system 100 is set to Armed Away Mode, such as by selecting the feature or entering a predetermined code at the system control panel 102 or one of the input devices 190-194, or by using the Arm button 196. As discussed previously, all of the security devices, such as the first through N door sensing units 104-108, first through N window sensors 142 and 144, and the motion sensors 148 and 149 within the perimeter 140 are armed in the Armed Away Mode.

At 202, the person 176 approaches the first door 112. The person 176 may be the owner of the home, a member of the business, or a contractor for example. As illustrated, the person 176 may have the first disarm device 150 in a pocket, although the first disarm device 150 may also be carried in a wallet, bag, purse, or other item. There is no need for the person 176 to locate the first disarm device 150 and/or position it at a particular position with respect to the first door sensing unit 104.

At 204, the processor 164 within the first disarm device 150 generates a disarm device packet 178 which comprises the Device ID 163 and the System ID 186 stored in the memory 162. At 206, the RF transceiver 166 transmits the disarm device packet 178. Line 208 indicates that the first disarm device 150 remains in a polling mode, meaning that disarm device packets 178 are regularly being generated and transmitted. There is no need to turn the first disarm device 150 on and off. When in the polling mode, the processor 164 may send the disarm device packet 178 at regular intervals, such as every seven seconds or ten seconds. The processor 164 may then switch the RF transceiver 166 to receive mode and wait a predetermined amount of time for an acknowledge packet. The processor 164 may then initiate a sleep mode to conserve battery power, remaining in sleep mode for a predetermined amount of time, such as five seconds. Optionally, the RF transceiver 166 may be disabled from transmitting the disarm device packet 178.

If the first disarm device 150 is within the RF detection field 168, at 210 the RF transceiver 170 of the first door sensing unit 104 receives the disarm device packet 178. At 212, the processor 175 compares the System ID 186 and the Device ID 163 sent in the disarm device packet 178 to the values (such as the System ID 186 and the list of approved Device IDs 182) stored in the memory 173. At 214, if the System and Device IDs in the disarm device packet 178 are the same as the System and Device IDs stored in the memory 173, the first disarm device 150 is an approved device. Alternatively, it should be understood that a single ID or value may be sent in the disarm device packet 178 and compared to a single value stored in the memory 173.

Optionally, at 216 the processor 175 may determine the position (open or closed) of the first door 112. If the first door 112 is closed, at 218 the first disarm device 150 may be validated and a false alarm may be prevented as discussed below in FIG. 5 associated with the Armed Stay Mode. If the first door 112 is open, the method passes to 220.

At 220, the processor 175 may optionally generate an acknowledge packet 180 which is transmitted by the RF transceiver 170 at 222 and received by the RF transceiver 166. At 224 the processor 175 prepares and sends a disarm system message to the system control panel 102. The control module 134 may then change the mode of the system 100 to Disarm Mode at 226. The system 100 is thus automatically disarmed without requiring input from the person 176. The person 176 may use a key to open the first door 112 and thus does not need to remember an access code to enter into the first input device 190 within a predetermined period of time to prevent a false alarm from being generated. Optionally, the person 176 may enter an access code if desired, or if the system 100 and/or first disarm device 150 are not operating properly, such as when the battery 167 within the first disarm device 150 is low. It should be understood that 220 and 222 may be performed at approximately the same time as the 224 and 226.

Returning to 214, if one or both of the System ID 186 and the Device ID 163 do not match approved values stored in the memory 173, the method passes to 228 where the disarm device packet 178 is discarded. For example, the first disarm device 150 may be for a different security system, and thus both the system ID 186 and the Device ID 163 may not match any value stored in the memory 173. Also, the first disarm device 150 may have been previously approved, such as to allow a contractor or employee access, then the access may have been terminated when the work was finished or the employee is no longer employed in the facility. Removing a Device ID from the list of approved Device IDs 182 may also be done if the first disarm device 150 is stolen or lost.

Figure 5:
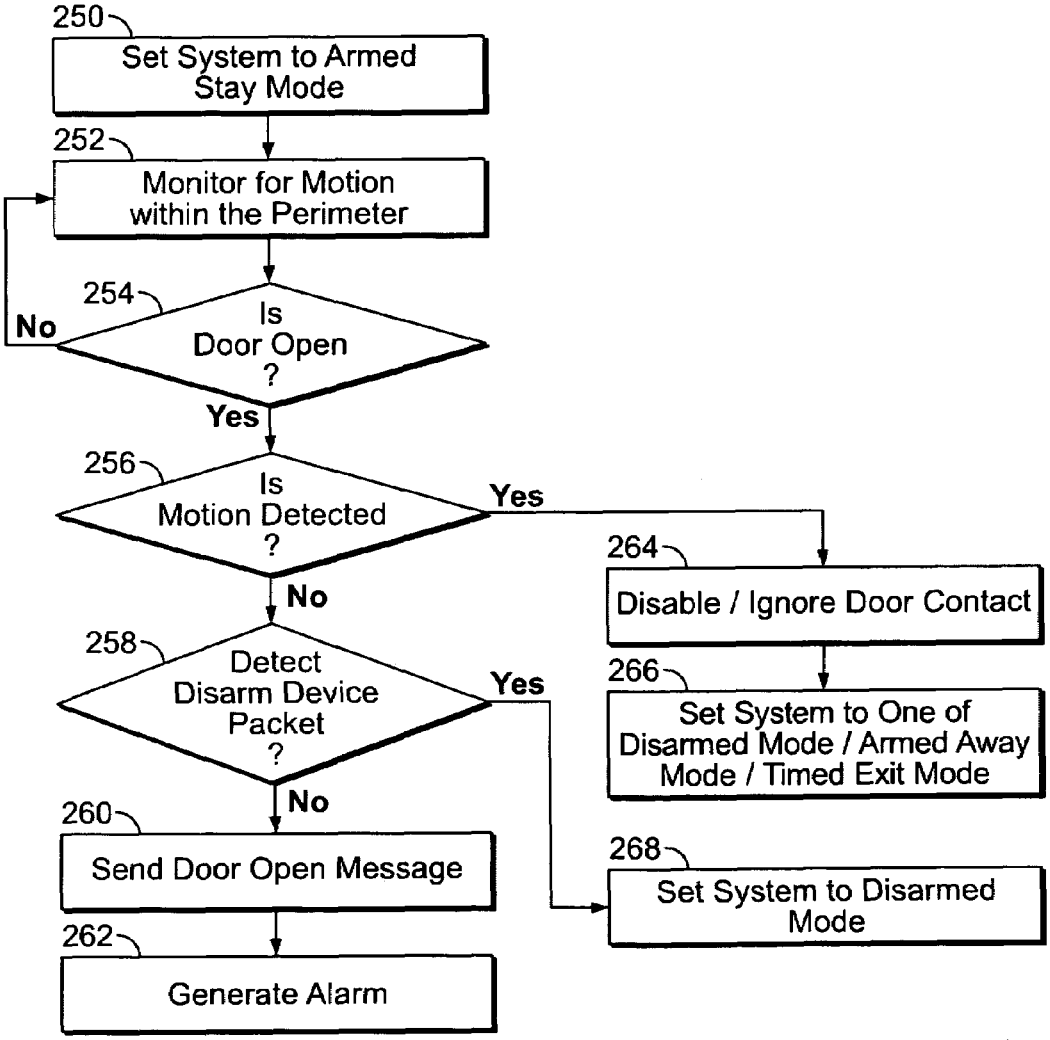
FIG. 5 illustrates a method for preventing the door sensing unit of FIG. 2 from generating a false alarm when the security system of FIG. 1 is in the Armed Stay Mode in accordance with an embodiment of the present invention The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block or random access memory, hard disk, or the like). Similarly, the programs may be stand alone programs, may be incorporated as subroutines in an operating system, may be functions in an installed software package, and the like. It should be understood that the various embodiments are not limited to the arrangements and instrumentality shown in the drawings.

FIG. 5 illustrates a method for preventing the door sensing units from generating a false alarm when the security system 100 is in the Armed Stay Mode. While inside the facility, people may not carry the disarm device on their person. Also, people who do not have access to a valid disarm device may be in the facility, such as a sub-contractor, visitors, and some employees. When the perimeter 140 is armed, it is desirable to protect the facility from unwanted persons coming in from the outside while still allowing people to leave the facility without generating a false alarm. By way of example, this may apply when the system 100 is used in a home and has been set in the Armed Stay Mode for overnight.

At 250, the system 100 is set to Armed Stay Mode. The system control panel 102 may send an activation message to each of the perimeter monitoring devices, such as the first through N door sensing units 104-108 and the first through N window sensors 142 and 144. The internal motion sensors 148 and 149 would not be armed. It should be understood that the Armed Stay Mode may also be disabled using the method of FIG. 3, such as if the person 176 with the first disarm device 150 entered from the outside through the first door 112.

At 252, the motion detector 174 (FIG. 2) of the first door sensing unit 104 monitors the area within the perimeter 140 proximate to the inside of the first door 112 for motion. Detection of motion by the motion detector 174 will not generate an alarm.

At 254, the processor 175 (FIG. 2) of the first door sensing unit 104 determines whether the door contact 172 has detected that the first door 112 is open. If the first door 112 is not open, the method returns to 252, monitoring for both motion and an open door. If the first door 112 is open, at 256 the processor 175 determines whether the motion detector 174 has detected motion within the perimeter 140. If motion is not detected, the method passes to 258 where the processor 175 determines whether a valid disarm device packet 178 has been received by the RF transceiver 170. If a valid disarm device packet 178 has not been received, the method passes to 260 where the processor 175 sends a Door Open message to the system control panel 102. At 262, the system control panel 102 generates an alarm. Returning to 258, if a valid disarm device packet 178 is received, the system 100 is disarmed at 268.

Returning to 256, if motion is detected, the method passes to 264 where the processor 175 may disable the door contact 172 and/or ignore the door open signal from the door contact 172. A door open signal is not sent to the system control panel 102 and an alarm is not generated.

At 266, the processor 175 may send a signal to the system control panel 102 to set the system 100 to Disarmed Mode. Therefore, if the person who exited the facility through the first door 112 returns and does not have a disarm device, a false alarm will not be generated. Alternatively, the system 100 may be set to Armed Away Mode. Alternatively, the system 100 may enter a Timed Exit Mode for a predetermined amount of time, such as 30 seconds. When in Timed Exit Mode, the processor 175 may ignore the door control signal and/or disable the door contact 172. After the predetermined amount of time has elapsed, the system 100 is reset to the Armed Stay Mode, continuing to provide protection from intruders. Therefore, if the first door 112 is subsequently opened externally, an alarm is generated. The Timed Exit Mode allows people to leave the house or facility without having to interact with the system 100.

When a person is attempting to arm the system 100, the door sensing units 104-108 prevent the disarm device 150-154 carried on the person from automatically disarming the system 100. For example, the person has the first disarm device 150 and sets the system 100 to Armed Away Mode or Armed Stay Mode at the input device 190. The RF transceiver 170 receives the disarm device packet 178 and the processor 175 identifies the System ID 186 and the Device ID 163. The processor 175 inhibits the Disarm Message from being sent to the system control panel 102. In other words, the first disarm device 150 is temporarily disqualified from disarming the system 100. The processor 175 may disqualify the first disarm device 150 for a predetermined period of time, such as two minutes, three minutes, or five minutes, after which time the system 100 will again respond to a disarm device packet 178 from the first disarm device 150 by disarming the system 100.

While in Armed Stay Mode, the processor 175 may track the disarm devices 150-154 over time. For example, if the first disarm device 150 is detected for a predetermined amount of time, such as two minutes, the first disarm device 150 is disqualified from disarming the system 100 to prevent unintentional disarming. Any mode change in the system 100, such as disarming and then re-arming, may re-qualify all of the disarm devices 150-154. Also, if the first disarm device 150 was previously disqualified but has not been detected within a predetermined period of time, the first disarm device 150 may be re-qualified. Therefore, if someone leaves the house with the first disarm device 150 which has been disqualified, the first disarm device 150 is re-qualified and thus may disarm the system 100 when the person returns.

It should be understood that partitions may be established, such as to group one or more sensors into a partition. Therefore, the system control panel 102 may send an Armed message to some perimeter devices (within a first partition) and not others (within a second partition). This may be the case when a security system is shared between more than one business, or if it is desirable to only monitor a portion of the entire area.

While the invention has been described in terms of various specific embodiments, those skilled in the art will recognize that the invention can be practiced with modification within the spirit and scope of the claims.

What is claimed is:

1. A security system configured to monitor at least one door, comprising:

a system control panel for arming and disarming the security system, the security system being set to an Armed Stay Mode, the security system comprising at least one Armed Mode and a Disarmed Mode;

means for detecting motion proximate to one side of a door and within a perimeter that extends at least partially around an area to be monitored by the security system;

means for detecting an open position of the door; and means for setting the security system to the Disarmed Mode when the motion is detected at substantially the same time as the open position of the door is detected.

2. The security system of claim 1, further comprising a disarm device comprising an RF transceiver for transmitting a disarm device packet configured to set the security system to the Disarmed Mode.

3. The security system of claim 1, further comprising a disarm device configured to transmit a disarm device packet that comprises at least one identifier associated with at least one of the security system and the disarm device.

4. The security system of claim 1, further comprising:

means for storing a first System identifier (ID) associated with the security system and a first Device identifier (ID) associated with at least one approved disarm device;

means for processing a disarm device packet, the disarm device packet being transmitted proximate to the door by the at least one approved disarm device, the disarm device packet further comprising a second System ID and a second Device ID; and means for comparing the first and second System IDs and the first and second Device IDs, the security system being set to the Disarmed Mode when the first and second System IDs are the same and the first and second Device IDs are the same.

5. The security system of claim 1, further comprising:

a disarm device comprising an RF transceiver, the RF transceiver transmitting disarm device packets regularly over time;

means for detecting the disarm device packets proximate to the door; and means for disqualifying the disarm device after the means for detecting the disarm device packets has detected the disarm device packets for a predetermined amount of time.

* * * * *